United States Patent [19]

Griffin

[11] 4,239,221

[45] Dec. 16, 1980

[54] GAME DEVICE

[76] Inventor: Albert N. Griffin, 1321 Stagecoach Rd. SE., Albuquerque, N. Mex. 87123

[21] Appl. No.: 5,901

[22] Filed: Jan. 23, 1979

[51] Int. Cl.[3] ..... A63B 71/06

[52] U.S. Cl. ..... 273/127 R; 273/146; 273/128 R

[58] Field of Search ..... 273/95 R, 108, 102 R, 273/106 R, 179 R, 178 R, 127 R, 127 B, 127 C, 123 R, 118 R, 124 R, 125 R, 126 R, 138 R; D21/5

[56] References Cited

U.S. PATENT DOCUMENTS

| | | | |
|---|---|---|---|
| 103,774 | 5/1870 | Plumb | 273/138 R |
| 675,842 | 6/1901 | Schank | 273/124 R |
| 1,203,472 | 10/1916 | Branch | 273/95 R |
| 2,164,808 | 7/1939 | Everett | 273/125 R |
| 2,326,859 | 8/1943 | Hoover | 273/95 R |
| 2,926,915 | 3/1960 | Jones | 273/95 R |
| 3,176,990 | 4/1965 | Aliff | 273/106 R |
| 3,275,325 | 9/1966 | MacKenzie | 273/95 R |
| 3,400,932 | 9/1968 | Conrad | 273/95 R |
| 3,891,213 | 6/1975 | Cooper | 273/127 R |
| 4,148,487 | 4/1979 | Bouve | 273/127 B |

FOREIGN PATENT DOCUMENTS

| | | | |
|---|---|---|---|
| 2334389 | 12/1977 | France | 273/95 R |

*Primary Examiner*—Richard C. Pinkham
*Assistant Examiner*—T. Brown
*Attorney, Agent, or Firm*—Clarence A. O'Brien; Harvey B. Jacobson

[57] ABSTRACT

A game device including a target in the form of an open sided box-like structure having an inclined ramp at the open side thereof, concentric circles and numerical indicia on the bottom surface thereof to provide scoring capabilities in playing various games. A cube or cubes having rounded corners are rolled toward the target by the players with the cubes including arabic numerals on five sides thereof and an arithmetical symbol on the sixth side, thereby enabling various sporting events to be simulated, teaching basic math skills to children while providing entertainment and utilizing the element of skill as well as the element of chance.

6 Claims, 8 Drawing Figures

Fig. 1
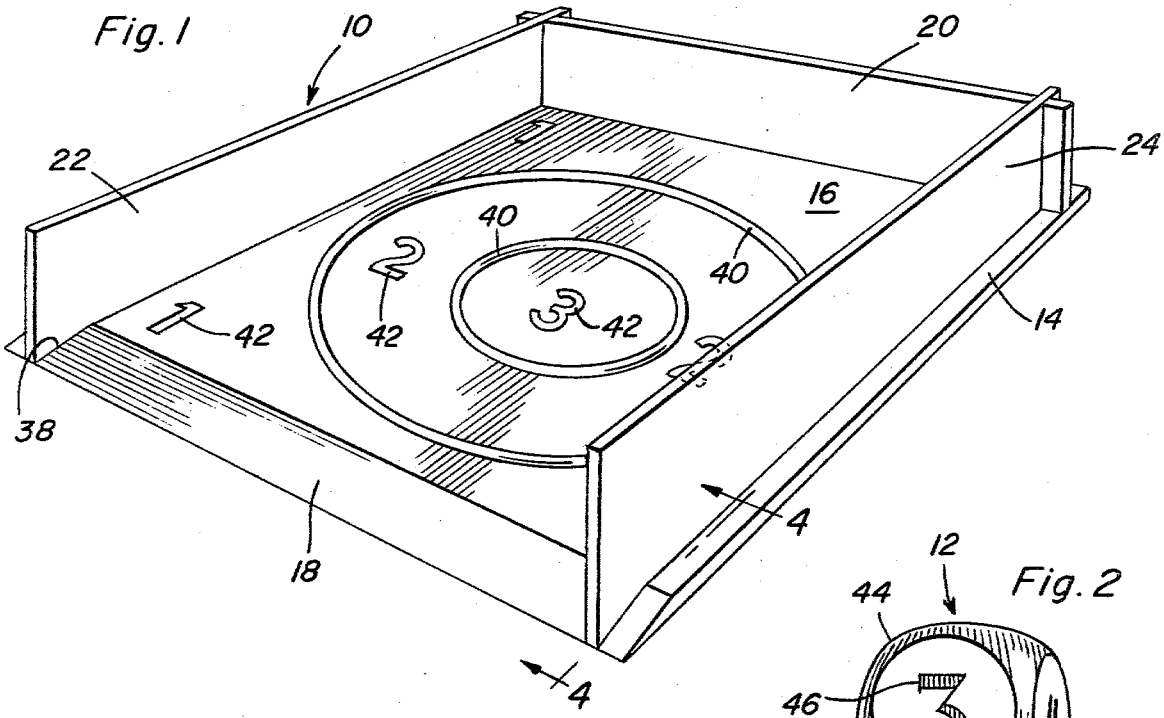
Fig. 2
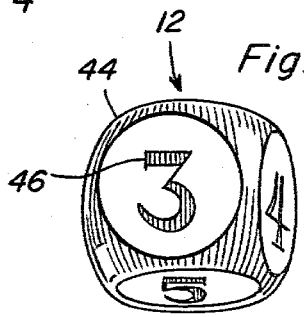
Fig. 3
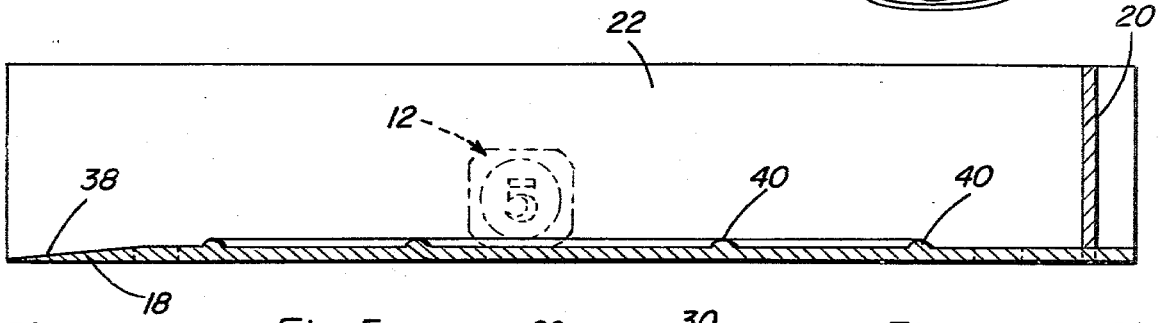
Fig. 5
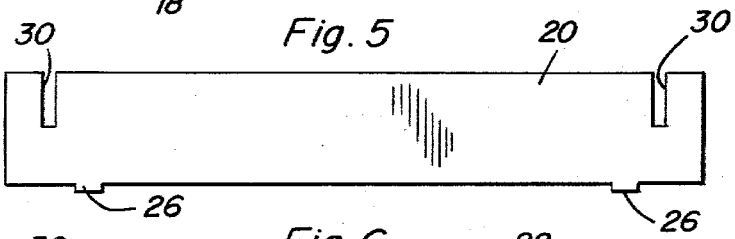
Fig. 4
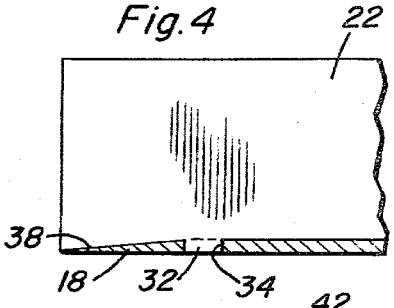
Fig. 6
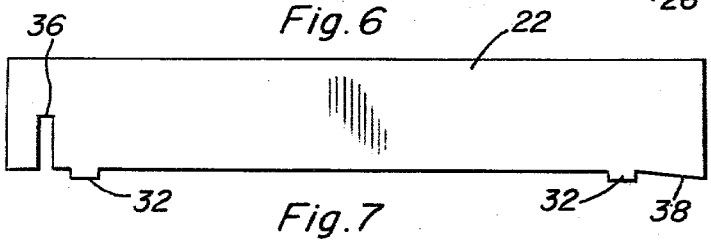
Fig. 7
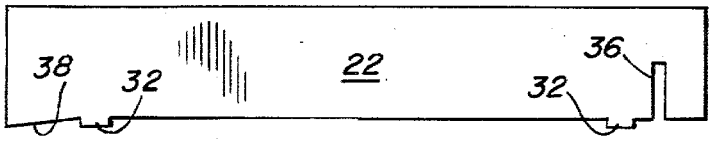
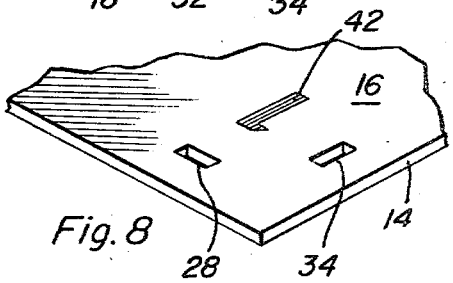
Fig. 8

GAME DEVICE

BACKGROUND OF THE INVENTION

1. Field of the Invention

The present invention generally relates to a game device including a target adapted to be supported on a supporting surface and including an open sided box with an entrance ramp and cubes rollable toward the target with both the target and cubes including indicia utilized in simulating various sporting events by using various rules of play.

2. Description of the Prior Art

Various types of game devices utilized to simulate sporting events are known, with such devices including game boards, targets, and the like, combined with chance devices such as dice or the like associated with game boards and hand projected devices associated with the targets with various rules of play being utilized to simulate actual sporting events. The following U.S. patents are exemplary of the prior development in this field of endeavor:

U.S. Pat. Nos. 787,792—Apr. 18, 1905
1,527,473—Feb. 24, 1925
2,433,224—Dec. 23, 1947
2,528,029—Oct. 31, 1950
2,893,734—July 7, 1959
3,400,932—Sept. 10, 1968.

SUMMARY OF THE INVENTION

An object of the present invention is to provide a game device utilizing a target with score indicating indicia thereon combined with cubes rollable toward and onto the target with the cubes having score indicating indicia thereon correlated with the indicia on the target to enable players to obtain scores for use in simulative playing of various games or sporting events.

Another object of the present invention is to provide a game device in accordance with the preceding object in which the target includes a box-like structure having an open side with an inclined ramp extending from a supporting surface to the upper surface of a bottom panel and removable bumpers or fences around three sides of the panel to retain a cube or cubes on the target area defined by the upper surface of the bottom panel of the box-like structure.

Still another object of the present invention is to provide a target for use in game devices in accordance with the preceding object in which the target is defined by concentrically disposed rings raised from the surface of the bottom panel with arabic numerals in each of the areas defined by the rings with the outermost arabic numeral defining the area between the outermost ring and the periphery of the target areas with the arabic numerals decreasing in value from the central target area to the outermost target area.

A still further object of the invention is to provide a game device in accordance with the preceding objects in which the cube is provided with rounded corners and arabic numerals on five of the six sides and an arithmetical symbol in the form of a "minus" (—) symbol appearing on the sixth side.

Yet another object of the invention is to provide a game device which utilizes elements of skill and chance to simulate various sporting events with basic math skills being taught while providing entertainment to the players.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of the target forming one component of the game device.

FIG. 2 is a perspective view of one of the cubes forming another component of the game device.

FIG. 3 is a longitudinal sectional view of the target illustrating one of the cubes thereon in broken lines.

FIG. 4 is a fragmental sectional view illustrating the specific construction of the bottom panel of the box-like target and the associated fence structure.

FIG. 5 is an elevational view of the end fence.

FIG. 6 is an elevational view of one of the side fences.

FIG. 7 is an elevational view from the opposite side of the side fence.

FIG. 8 is a fragmentary perspective view of one corner of the bottom panel.

DESCRIPTION OF THE PREFERRED EMBODIMENT

Referring now specifically to the drawings, the target component of the game device of the present invention is generally designated by reference numeral 10 and the cube component is generally designated by numeral 12 with a cube or cubes being rolled toward the target 10 by the players in accordance with various rules of play for simulating various sporting events.

The target 10 is in the form of a box-like structure adapted to rest on a supporting surface which may be a floor surface when used indoors or any suitable surface when used outdoors. The target 10 includes a generally square bottom panel 14 having a generally planar upper surface 16 and one bevelled edge 18 which may be considered the front edge of the target to provide a guide or ramp for the rolling cubes 12 as they approach the target so that they will roll up the ramp defined by the bevelled edge 18 onto the surface 16 which may be considered a target area. The remainder of the target is provided with upstanding bumpers or fences including an end fence 20 parallel to the bevelled edge 18 but remote therefrom as illustrated in FIG. 1 and side fences 22 and 24 which are of identical construction and disposed in spaced parallel relation to each other adjacent the side edges of the bottom panel 14 and in perpendicular relation to the end fence 20 and the planar top surface 16 of the bottom panel 14.

The end fence 20 is generally rectangular in construction and provided with a pair of depending tabs or tongues 26 along the bottom edge thereof for reception in a pair of correspondingly shaped apertures 28 in the bottom panel 14 so that the straight bottom edge of the end fence 20 will rest against the top planar surface 16 of the bottom panel 14 when the tabs 26 are inserted into the rectangular apertures 28. Also, the top edge of the end fence 20 is provided with a pair of vertically disposed notches 30 which extend from the top edge downwardly for approximately one-half of the width of the end fence 20.

The side fence 22 as illustrated in FIGS. 6 and 7 includes a pair of depending tabs 32 along the bottom edge thereof for reception in apertures 34 along the side edge of the bottom panel 14. Adjacent one end of the side fence 22, a notch 36 is provided which extends upwardly from the bottom edge of the fence 22 for approximately one-half of the width of the side fence 22 for interlocking engagement with one of the notches 30 in the end fence 20 thereby interlocking the side fence 22 with the end fence 20 in perpendicular relation thereto. The end of the side fence 22 remote from the end thereof having the notch 36 therein is provided with a downwardly inclined bottom edge portion 38 which conforms with and engages the top surface of the bevelled edge 18 as illustrated particularly in FIG. 4 which also illustrates the relationship of the adjacent tab or tongue 32 and aperture 34 in the side edge portion of the bottom panel 14. While side fence 22 has been described in detail, the other side fence 24 is of identical construction. This construction enables assembly and disassembly of the fences 20, 22 and 24 with respect to the bottom panel 14 to enable compact storage and shipment of the target with the fences being easily assembled by first assembling the end fence 20 to the bottom panel 14 and then assembling the side fences 22 and 24 with respect thereto. The interlocking engagement between the fences and the bottom panel and between the side fences and the end fence provides a stable fence structure which cooperates with the bottom panel 14 to provide an open sided box-like target structure forming one component of the game device.

The planar upper surface 16 of the bottom panel 4 is provided with concentric raised ridges 40 defining an inner circular target area, an outer concentric annular target area and an outermost target area disposed between the outermost ring and the fences. Arabic numerals 42 of decreasing value are provided in the inner circular target area, the annular target area and the outermost target area with the numerical indicia in the annular target area being at opposite sides of the inner target area and in alignment with the indicia in the inner target area while the indicia in the outermost target area is located at each of the four corners of the target area. The numerical indicia may be distinguishably colored or otherwise distinguishably formed for easy observation thereof and the target areas may be of the same color with the ridges of distinguishable color or the ridges may be the same color as the target area or the target areas may be suitably distinguishably colored in any suitable manner. Also, the target may be constructed of various materials, such as wood, plastic, metal, or any other desired materials and the device may be constructed of any suitable size with the target generally being square in configuration so that the target areas are symmetrical with respect to the center of the bottom panel.

Each of the cubes 12 includes a cubical member having rounded corner surfaces 44 with each side being provided with indicia 46 thereon with five sides of the cubical body having arabic numerals and the sixth side having a "minus" symbol thereon. The cubes may be constructed of wood, plastic, or the like, and are preferably of solid core construction with one acceptable material being "Plexiglas". The cube is preferably constructed by utilizing a spherical ball of a predetermined diameter being cut so that six flat sides of circular configuration are formed thereon with the body being of one color and the numerals being of a contrasting easily distinguishable color. The materials and dimensions of the cubes may also vary depending upon the dimensional characteristics of the target.

While various dimensions may be used, it has been found that a target of approximately 24"×24" can be practically used for playing various games with the cube being defined by a 2" diameter ball having $1\frac{1}{2}$" circles cut along opposite surfaces thereof to form the six flat circular surface areas with the indicia being the digits 1–5 and a "minus" (−) symbol. In the target, the diameter of the inner target area may be 6" and the diameter of the outer target area may be 14", thus providing adequate target areas for the cubes to come to rest on. The cubes are of a convenient size to be easily held in the palm of a hand and the rounded corner surfaces 44 thereof enable the cubes to be accurately rolled toward the target, thereby introducing the necessity of utilizing skill in rolling the cubes as well as utilizing the element of chance. The use of arabic numerals and mathematical symbols teaches basic math skills, while at the same time providing entertainment. The arabic numerals are better suited for teaching math skills as compared to pips normally found on chance control cubes.

Various games or sporting events may be simulated by utilizing the game device of this invention. Players should stand at a prescribed distance from the target and a foul line provided at that point with a reasonable distance being 10' to 15' for outside use and for inside use, it may be on the order of 6' to 10'.

A basic game which may be played is "21" which may be played by two or more players with one player designated as the dealer who rolls last. Each player rolls two cubes into the target or scoring box and both cubes must land in the scoring box, otherwise the player "breaks". The score for the hand is determined by multiplying the number on the scoring cube by the number on the area of the scoring box in which it lands. Both cubes are counted for the total in each hand. If the total for both cubes exceeds 21, the player "breaks" and loses the hand. A "minus" counts either 1 to 11. A player may roll one or more additional times to improve the hand, however, if the total of all cubes thrown exceeds 21, the player "breaks" and loses that hand. "Minus" on both cubes is an automatic winner for that player. Ties between a player and the dealer are "pushes" and neither wins. Game chips may be utilized by the players in a conventional manner.

Another basic game which may be played is any number of players deciding the number of turns to be taken and each player rolls the cubes the predetermined number of times and the highest total score made is the winner. In this type of game, if one of the cubes does not land in the scoring box, no score will be made for that turn and if a "minus" is rolled, it will count as 20 regardless of the scoring area on which it lands. Games simulating baseball, basketball, golf and tennis may also be played with conventional score keeping techniques being employed and various rules of play being employed simulative of the actual rules of play utilized when playing these games. Thus, children using the device develop skills in rolling the cubes, learn basic math skills, rules of playing various games and at the same time receive entertainment benefits derived from playing various games.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A game device comprising a target in the form of a box-like structure having one open side with an inclined ramp surface along the open side and a target area inwardly of the open side and cubical bodies rollable toward the target for positioning on the target area, said target area including concentrically defined areas with scoring indicia thereon, each cubical body including six flat surfaces with scoring indicia thereon cooperating with the scoring indicia on the target areas to score points to play various games, said target including a bottom panel with the ramp formed along one edge thereof by bevelling the edge of the panel, a pair of parallel upstanding side fences attached to the bottom panel and an end fence attached to the bottom panel in parallel relation to the ramp and at the opposite edge of the bottom panel, means detachably connecting each of the fences to the bottom panel and means detachably interconnecting each end of the end fence to an adjacent end of a side fence, the bottom edge of each side fence including a downwardly slanted end portion conforming with and engaging the ramp.

2. The structure as defined in claim 1 wherein each of the cubical bodies includes a spherical ball having six circular flat sides formed thereon with the periphery of the body externally of the flat sides being the remaining portions of a spherical ball, said indicia on said cubical body including digits 1–5 and "—", said indicia on the target areas being arabic numerals decreasing in numerical value from the inner target area outwardly.

3. The structure as defined in claim 1 wherein said means detachably connecting the fences to the bottom panel including depending tabs on the fences and slot-like openings along the edges of the bottom panel receiving the tabs, said means detachably connecting the end of the end fence to an end of a side fence including vertically extending notches in each fence approximately one-half the width of the fence for vertical interlocking engagement.

4. A game device comprising a target in the form of a box-like structure having one open side with an inclined ramp surface along the open side and a target area inwardly of the open side and cubical bodies rollable toward the target for positioning on the target area, said target area including concentrically defined areas with scoring indicia thereon, each cubical body including six flat surfaces with scoring indicia thereon cooperating with the scoring indicia on the target areas to score points to play various games, each of the cubical bodies including a spherical ball having six circular flat sides formed thereon with the periphery of the body externally of the flat sides being the remaining portions of a spherical ball, said target including a bottom panel with the ramp formed along one edge thereon by bevelling the edge of the panel, a pair of parallel upstanding side fences attached to the bottom panel and an end fence attached to the bottom panel in parallel relation to the ramp and at the opposite edge of the bottom panel, means detachably connecting each of the fences to the bottom panel and means detachably interconnecting each end of the end fence to an adjacent end of a side fence, said means detachably connecting the fences to the bottom panel including depending tabs on the fences and slot-like openings along the edges of the bottom panel receiving the tabs, said means detachably interconnecting the end of the end fence to an end of a side fence including vertically extending notches in each fence approximately one-half the width of the fence for vertical interlocking engagement, and the bottom edge of each side fence includes a downwardly slanted end portion conforming with and engaging the ramp.

5. The structure as defined in claim 4 wherein said indicia on said body includes digits 1–5 and "—", said indicia on the target areas being arabic numerals decreasing in numerical value from the inner target area outwardly.

6. In a game device, a target comprising a box-like structure having a bottom panel, a pair of parallel upstanding side fences attached to the bottom panel, an end fence attached to an end portion of the bottom panel with the opposite end edge of the bottom panel being open and provided with an inclined ramp formed by bevelling the open end edge of the bottom panel whereby game pieces approaching the target will roll onto the upper surface of the body panel and be retained thereon by said fences, means detachably connecting each of the fences to the bottom panel, means detachably interconnecting each end of the end fence to an adjacent end of a side fence, the bottom edge of each side fence including a downwardly slanted end portion conforming with and engaging the ramp formed along the open end of the bottom panel of the target, said bottom panel including concentrically arranged ridges and having scoring indicia thereon to define a target area whereby game pieces will be confined by the fences and come to rest on the bottom panel with respect to the ridges to enable points to be scored in playing various games.

* * * * *